US005132732A

United States Patent [19]

Kalyandurg et al.

[11] Patent Number: 5,132,732

[45] Date of Patent: Jul. 21, 1992

[54] DUAL AXIS DISPLACEMENT LIFTING MECHANISM FOR A DEVELOPMENT APPARATUS

[75] Inventors: Satyan R. Kalyandurg, Rochester; Salvatore C. DeFazio, Bergen; Frank Hacknauer, Honeoye Falls; Edward S. Nudelman, Rochester, all of N.Y.

[73] Assignee: Eastman Kodak Company, Rochester, N.Y.

[21] Appl. No.: 644,166

[22] Filed: Jan. 22, 1991

[51] Int. Cl.[5] ..... G03G 15/06

[52] U.S. Cl. ..... 355/245; 118/645; 118/657; 355/251; 355/326

[58] Field of Search ..... 355/245, 253, 251, 260, 355/326, 327, 259; 118/653, 657, 658, 645, 656; 222/DIG. 1

[56] References Cited

U.S. PATENT DOCUMENTS

| | | | |
|---|---|---|---|
| 3,953,121 | 4/1976 | Reichart et al. . | |
| 4,841,330 | 6/1989 | Owada et al. . | |
| 4,866,482 | 9/1989 | Hirasawa et al. . | |
| 4,891,674 | 2/1990 | Seyfried | 355/245 |
| 4,920,381 | 4/1990 | Mahoney | 355/260 |
| 4,958,191 | 9/1990 | Yamada et al. | 355/245 |
| 4,963,936 | 10/1990 | Carter . | |

*Primary Examiner*—A. T. Grimley
*Assistant Examiner*—Thu Dang
*Attorney, Agent, or Firm*—Tallam I. Nquti

[57] ABSTRACT

A mounting system is provided for the development apparatus of the development station of an electrostatographic reproduction apparatus such as a copier or printer. The system includes a dual axis automatic lifting mechanism that includes a lever assembly displaceable along the vertical and horizontal axes, and a swivellable spring and plunger assembly which imparts a generally diagonal displacement force to the lever assembly.

10 Claims, 9 Drawing Sheets

DUAL AXIS DISPLACEMENT LIFTING MECHANISM FOR A DEVELOPMENT APPARATUS

BACKGROUND OF THE INVENTION

Technical Field

This invention relates to development stations in electrostatographic reproduction apparatus, and more particularly to a mounting system which includes a dual axis displacement mechanism in such a station for lifting the development unit thereof.

Electrostatographic process apparatus, which for example produce or reproduce toned images on selected substrates by employing electrostatic charges and toner particles on an insulated photoconductive surface, typically operate through a sequence of currently well known steps. These steps include (1) charging of the insulated photoconductive surface with electrostatic charges, (2) forming a latent image electrostatically on such surface by selectively discharging areas on such surface, (3) developing the electrostatic image so formed with particles of toner, (4) transferring the toned image to a suitable substrate for fusing thereon to form a permanent record, and (5) cleaning by removing residual toner and/or other particles from the photoconductive surface in preparation for similarly producing another image.

The quality of the images produced by such apparatus depends, in part, and significantly so, on the ability to precisely locate a development unit of the apparatus relative to the image-bearing member, as well as on regularly and easily servicing and replacing such a development unit. Various devices and mechanisms have therefore been developed for mounting, moving and supporting a development unit relative to the image-bearing member of such apparatus. Such devices and mechanisms are disclosed for example in U.S. Pat. Nos. 3,953,121 issued to Reichart et al on Apr. 27, 1976 ; 4,841,330 issued to Owada et al on Jun. 20, 1989 ; 4,866,482 issued to Hirasawa et al on Sep. 12, 1989 ; and 4,963,936 issued to Carter on Oct. 16, 1990. Unfortunately, in addition to cost, the mounting, as well as the loading and unloading of the development unit relative to the image-bearing member are ordinarily sources of problems and difficulties for such devices and mechanisms. On the one hand, complex and elaborate such devices and mechanisms are expensive and difficult to operate. On the other hand, the very simple one of such devices and mechanisms ordinarily do not independently interface the development unit with the image-bearing member and consequently, the development unit in each such case is not easy to load and unload as above. Therefore, serious problems such as overloading against the image-bearing member, and toner dusting may be experienced. In either case, precise loading of the development unit relative to the image-bearing member and easy serviceability are sources of difficulties, and usually the quality of images developed suffers.

SUMMARY OF THE INVENTION

It is an object of the present invention to provide a mounting system which independently interfaces a development unit with an image-bearing member of an electrostatographic reproduction apparatus.

It is another object of the present invention to provide such a mounting system which is simple and easy to operate.

It is a further object of the present invention to provide such a mounting system which includes precise dual axis displacement of the development unit from a lowered service position to an upraised development position.

In accordance with the present invention, a mounting system for a development unit is provided in the development station of an electrostatographic reproduction apparatus that includes an image-bearing member for forming latent images thereon. The mounting system includes a chassis assembly for supporting the development unit, a development unit holding platform, and an automatic lifting mechanism for lifting the development unit and the holding platform from a lowered service position to an upraised development position. The lifting mechanism includes a lever assembly which is displaceable along the vertical and horizontal axes, and a swivellable spring and plunger assembly for automatically imparting a generally diagonal displacement force to the lever assembly.

BRIEF DESCRIPTION OF THE DRAWINGS

In the detailed description of the invention presented below, reference is made to the drawings, to which.

DETAILED DESCRIPTION OF THE PRESENT INVENTION

Because electrostatographic reproduction apparatus are well known, the present description will be directed in particular to elements forming part of or cooperating more directly with the present invention. Elements not specifically shown or described herein are selectable from those known in the prior art.

Figure 1:
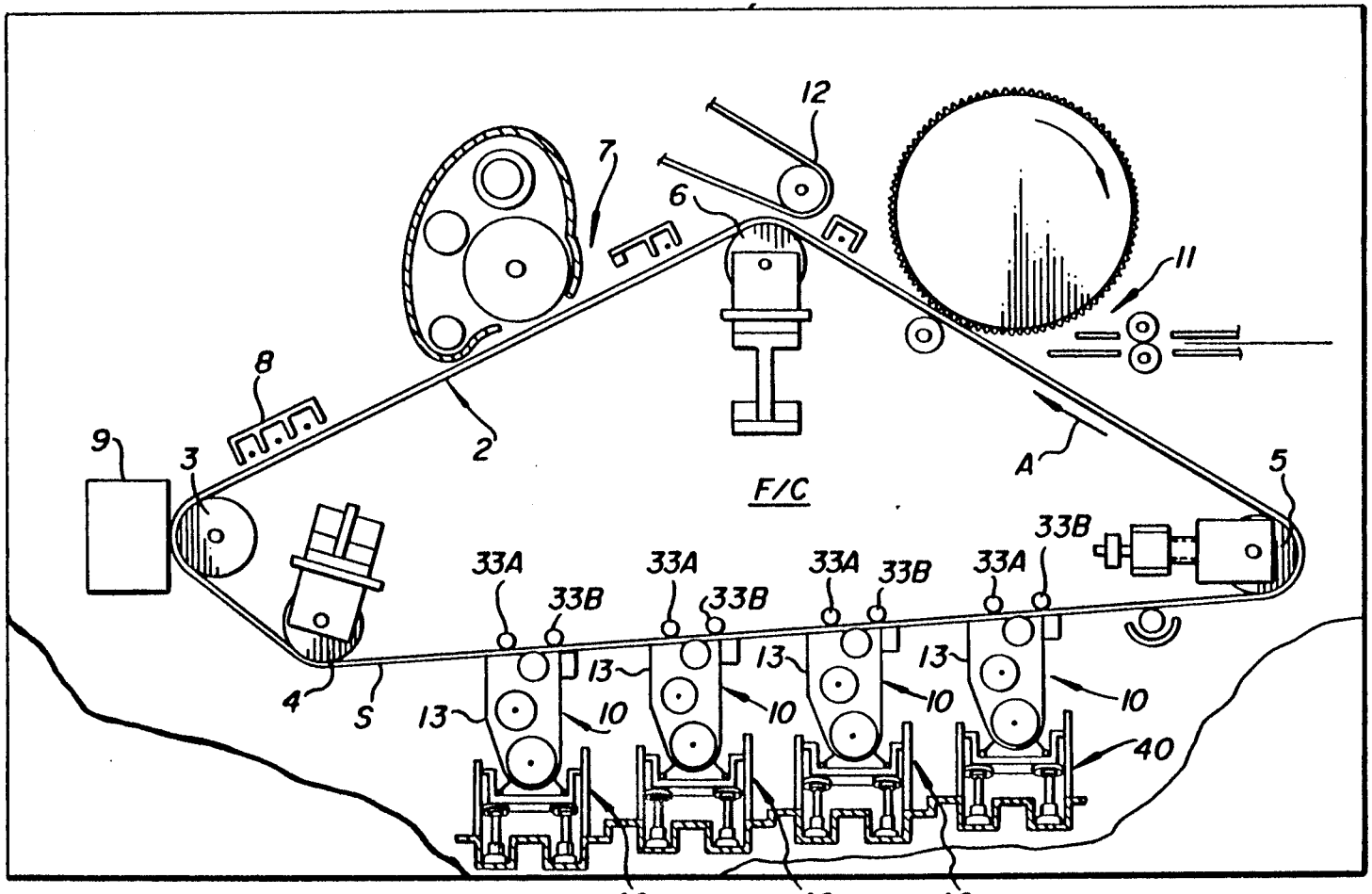
FIG. 1 is a schematic of an electrostatographic reproduction apparatus such as a copier or printer including the development unit mounting system of the present invention.

Referring now to the accompanying drawings, FIG. 1 shows an electrostatographic reproduction apparatus such as a printer 1. The apparatus 1 can, of course, also be a copier/duplicator. As shown, the apparatus 1 includes an endless flexible image-bearing member or film 2 that is trained for movement in the direction of the arrow A about a series of rollers 3, 4, 5 and 6, one of which is a drive roller. The image-bearing member or film 2 is mounted, as such, on a frame or film core F/C.

As is well known, copies of original documents and/or prints of documents can be produced on the printer or copier 1 according to the electrostatographic process. For such process, each moving portion of the image-bearing surface S of the image-bearing member 2, is (a) cleaned at a cleaning station 7, (b) uniformly charged at a charging station 8, and (c) then imagewise exposed at an exposure station 9. The exposure station 9 is shown as an electronic printhead but can equally consist of appropriate optical means as is well known.

Latent images or imagewise charge patterns formed at the exposure station 9 are next developed with toner particles at the development station of the present invention designated generally as 10. A plurality of such development stations 10 is shown in FIG. 1 and, as such, can each contain different color developer material, and thus they can be used in producing multiple-color copies or prints.

The developed image next moves to a transfer station 11 where it is transferred to a suitable receiver sheet. The sheet is thereafter separated from the image-bearing member 2 and then transported for fusing to a fusing apparatus (not shown), by transport means shown as 12.

Figure 2:
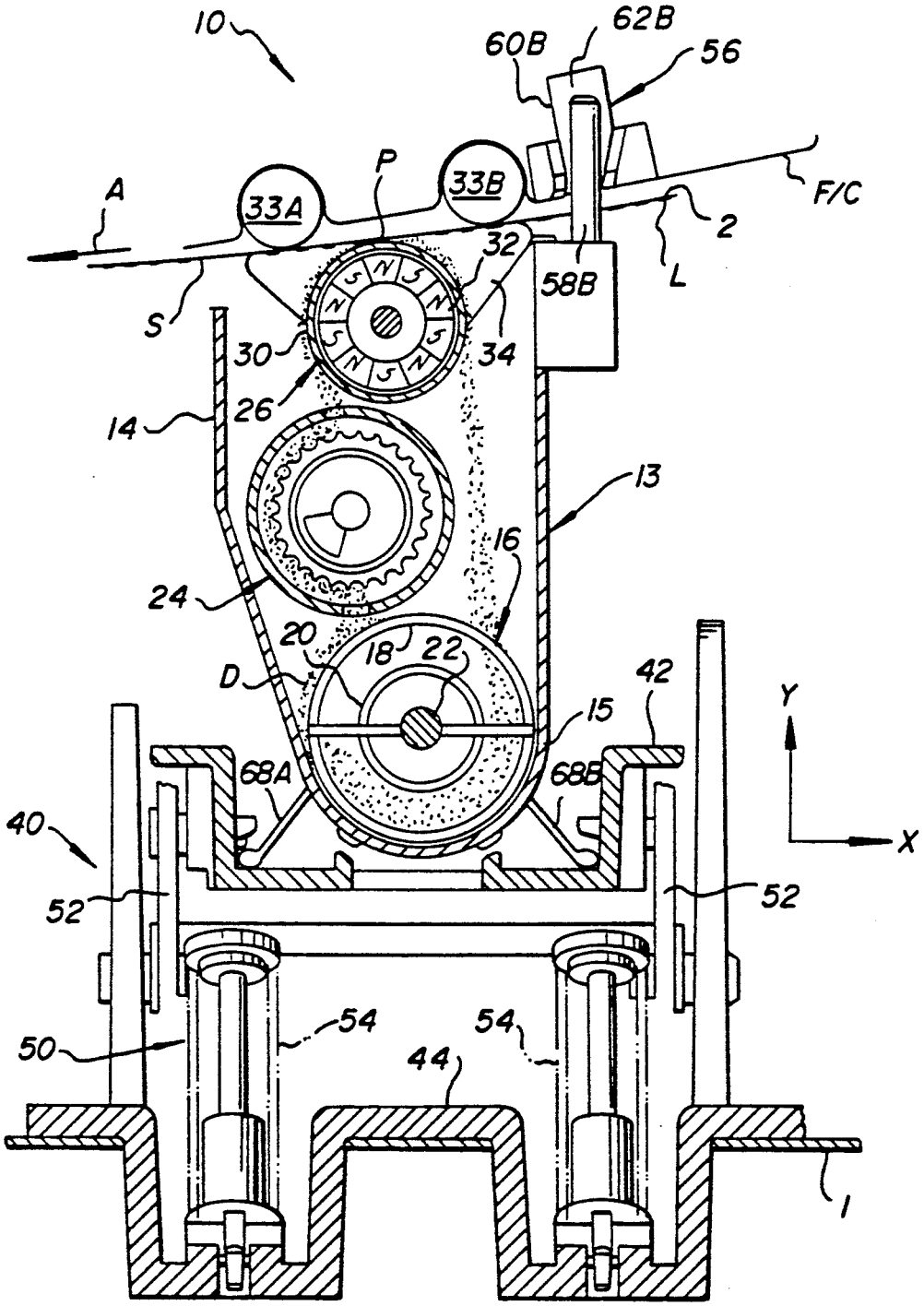
FIG. 2 is a front view partly in section of a development station of the copier or printer of FIG. 1.

Referring now to FIGS. 1 and 2, the development station 10 of the present invention is shown. The development station 10 includes a magnetic roller-type development unit 13 which is mountable in the electrostatographic copier or printer 1. As described above, the image-bearing member 2 of the printer 1 is movable in the direction, for example, of the arrow A relative to the development unit 13 of the station 10. The development unit 13 is adapted to supply developer material D, containing marking or toner particles, for developing latent charge images L on the image-bearing surface S of the member 2.

As shown, the development unit 13 comprises a housing 14 which has a sump portion 15 for holding a supply of the developer material D. The developer material D consists, for example, of small hard magnetic carrier particles and of fusable marking or toner particles. The carrier and toner particles are chargeable triboelectrically by means of a rotatable ribbon blender 16 mounted in the sump portion 15.

The ribbon blender 16 may comprise an outer ribbon 18 and an inner ribbon 20. Both inner and outer ribbons are coiled concentrically about, and are movable by a driven shaft 22. Movement of the ribbons 18 and 20 agitates the carrier and toner particles as well as moves them for delivery to a feed mechanism shown as 24. As shown, the feed mechanism 24 is located between the ribbon blender 16 and a magnetic brush or development roller means 26. Feed mechanism 18, as located, receives and feeds the charged carrier and toner particles to the magnetic development roller 26 which is located at the top of the housing 14 within an opening therein.

The development roller 26 may be of any suitable construction, and can include a non-magnetic shell 30 as well as a magnetic core 32. The shell 30 is rotatable about the core 32. The core 32 consists of a plurality of permanent magnets which are arranged in an alternating N-S pole pattern, and which can be rotated, for example, in a clockwise direction.

As shown in FIG. 2, a portion of the development roller 26 projects through the opening in the top of the housing 14 such that when the development unit 13 is properly mounted in a copier or printer 1, the projecting portion will lie directly adjacent, or within a desired proximity to the latent images L on the surface S of the flexible image-bearing member 2. The proximity should be such that toner particles will be transferred to the latent charge images L when developer material D consisting of charged carrier particles and charged toner particles is transported on the magnetic roller 26 past such charge images L. Such transfer of toner particles represents the development step of the electrostatographic process, and it takes place within a region of the development nip indicated as P.

As shown, the development station 10 also includes ski rods 33A, 33B which support the back side of the image bearing member or film 2 at a point directly across from the development unit 13. The rods 33A, 33B extend significantly beyond the width of the film 2 on each side thereof. In order to assist the spacing of the development roller 26 from the surface S, a ski plate 34 mounted to each end of the development roller 26 is adapted to contact and interface with the portions of the ski rods 33A, 33B which extend beyond the width of the film 2.

In accordance with the present invention, the development station 10 is provided with a mounting system designated generally as 40 for mounting the development unit 13 relative to the film or image-bearing member 2. The mounting system 40 is firmly attached independently of the film core F/C to the base of the frame of the copier or printer 1 by means of screws for example. The mounting system 40 as shown includes a platform assembly 42 for holding the development unit 13, and a chassis assembly 44 for supporting the platform assembly 42 as well as the development unit 13. The mounting system 40 also includes an automatic lifting mechanism 50 for lifting the platform assembly 42 and development unit 13 from a lowered service position (not shown in FIG. 2), to an upraised image development position shown, for example, in FIG. 2. In the upraised development position of FIG. 2, the ski plates 34 at each end of the development roller 26 will be in contact with the ski rods 33A, 33B.

Figure 3A:
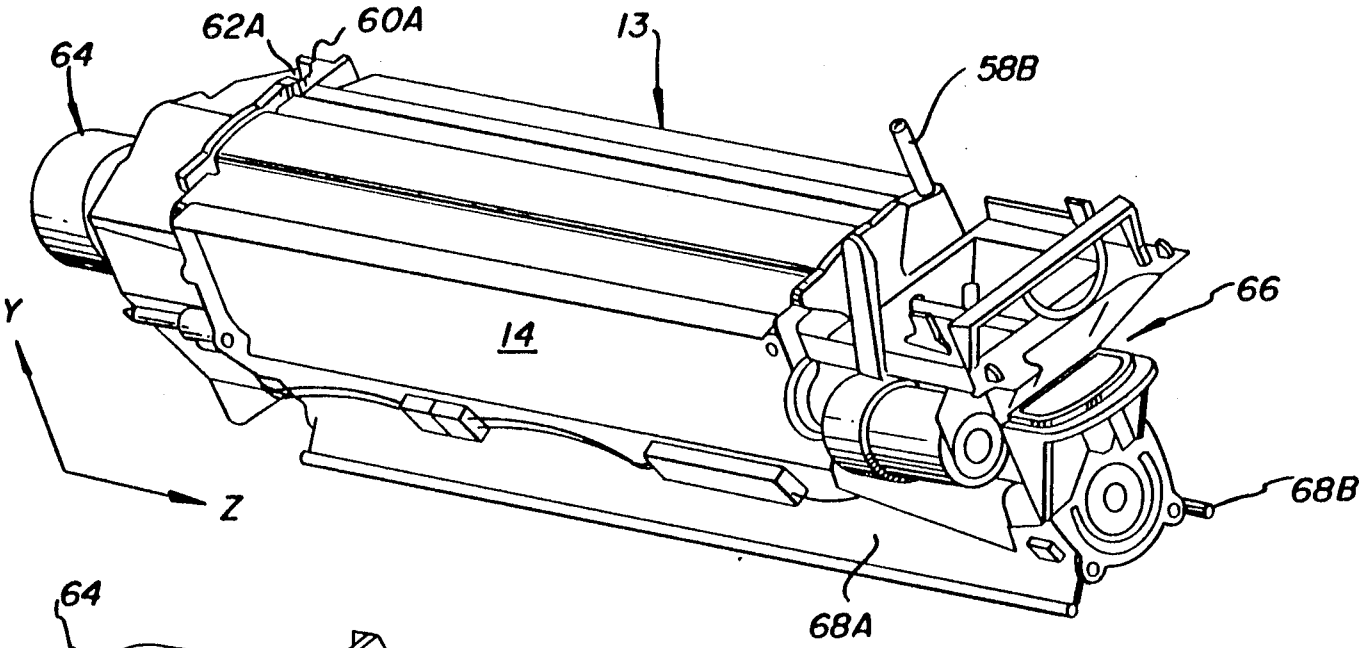
FIG. 3A is a perspective view of the development unit of the present invention.
Figure 4:
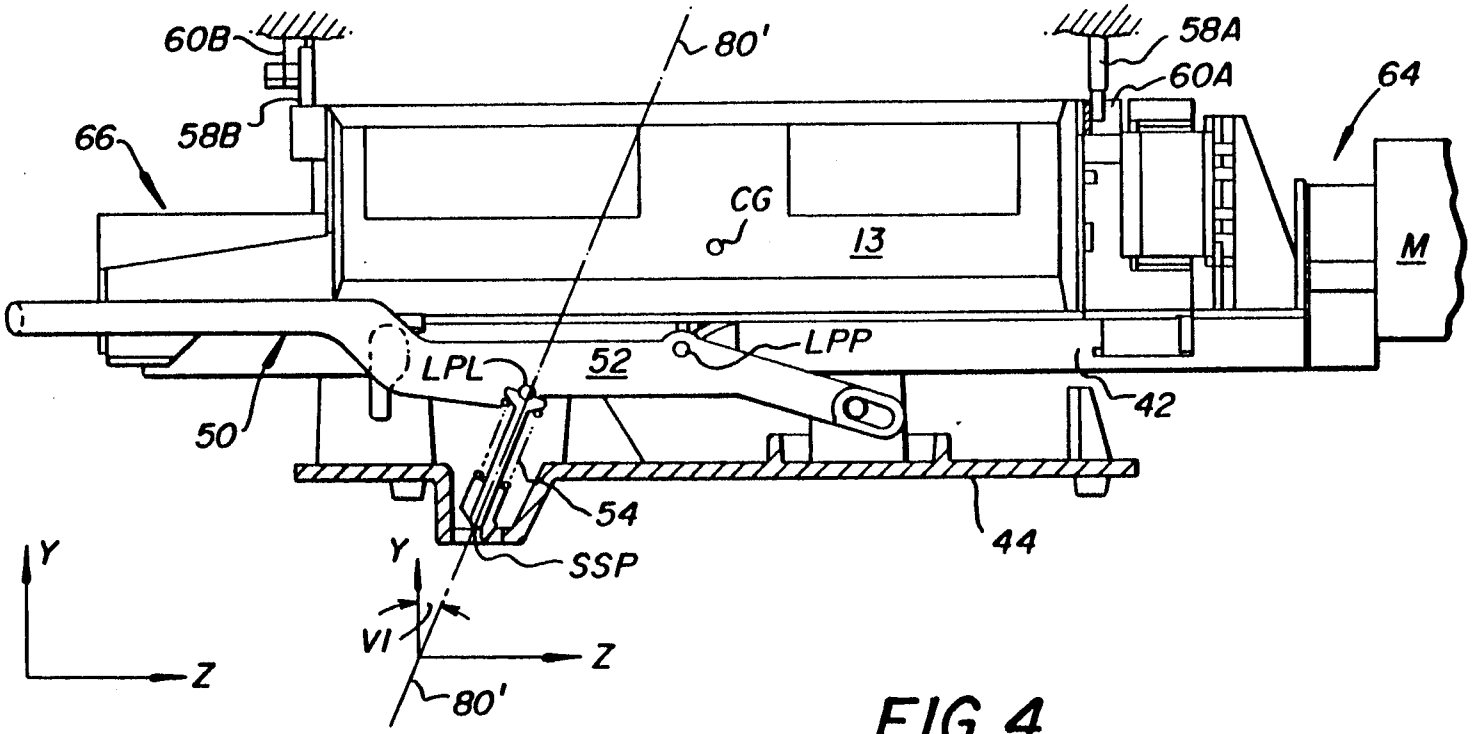
FIG. 4 is a side view, partly in section, of the development station of FIG. 2.

The lifting mechanism 50 includes a lever assembly 52 which is displaceable along the vertical axis shown as the Y-axis, and along the horizontal or Z-axis (FIGS. 3A and 4). The lifting mechanism 50 further includes a pair of swivellably mounted spring and plunger assemblies shown as 54 for each automatically imparting a generally diagonal displacement force to the lever assembly 52. Each spring and plunger assembly 54 is structurally and functionally identical to the other, therefore principally only one will be described herein.

Referring now to FIGS. 2 and 3A, the mounting system 40 also includes means shown partly in FIG. 2 as 56 for guiding and locating the development unit 13 from the lowered position to the upraised development position relative to the image-bearing member or film 2. The means 56 consists of a pair of guiding pins 58A, 58B and a pair of cooperating fork members 60A, 60B that each defines a pin retaining slot 62A, 62B, respectively. The means 56 are such that to the rear 64 of the station 10, the fork member 60A and the slot 62A are associated with the development unit 13 while the guiding pin 58A thereat is on the frame or film core F/C of the copier or printer 1. To the front 66 of the station 10 as shown in FIG. 2, the reverse is true so that the fork member and slot 60B, 62B, respectively, are on the film core F/C while the pin 58B is on the development unit 13. The details and operation of the means 56 will be described below in reference to FIGS. 11A–12D. As further shown in FIG. 3A, the development unit 13 includes leg portions 68A, 68B for mounting the unit 13 onto the platform assembly 42.

Figure 3B:
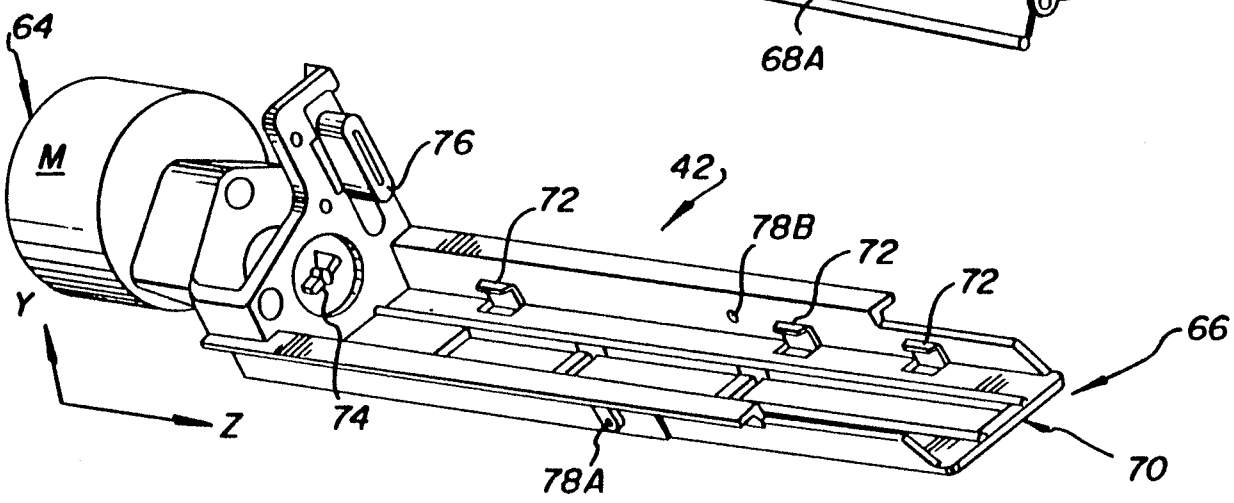
FIG. 3B is a perspective view of the development unit holding platform assembly of the present invention.

Referring now to FIG. 3B, the platform assembly 42 includes a frame 70 for slidably receiving the development unit 13. Means such as a series of interior tabs 72 on each side cooperate with the leg portions 68A, 68B to restrain the development unit in the Y or vertical axis. To the rear 64 thereof, the platform 42 includes means such as an electric motor M for driving the development unit 13 as well as a drive coupling 74 and an electrical connector 76. The platform 42 also includes means such as a pair of corresponding blind holes 78A, 78B in the sides of the frame 70 which receive lever pins for pivotably coupling the platform 42 to the lifting mechanism 50.

A side view of the development station 10 is illustrated in FIG. 4. As shown, the center of gravity of the development unit 13 assembled to the platform assembly 42 is designated generally as CG. The lifting mechanism 50 is coupled to the means 78A, 78B of the platform at a first load point shown as LPP. The point LPP by design is offset along the Z or horizontal axis frontwards from the center of gravity CG of the development unit/platform assembly. The spring and plunger assembly 54 is coupled to the lever assembly 52 at a second load point LPL which, as shown, is also offset frontwards along the Z or horizontal axis from the center of gravity CG, as well as from the platform load point LPP. The base of the spring and plunger assembly 54 is swivellably supported at a point SSP in the chassis assembly 44 such that in the upraised position (FIG. 4), the axis of the spring and plunger assembly lies along a line 80' which is inclined at an angle V1 from the Y or vertical axis. The lifting force of the spring and plunger assembly 54 therefore ends up being imparted to the lever assembly at the point LPL along the substantially diagonal line 80' in such upraised position.

Figure 5:
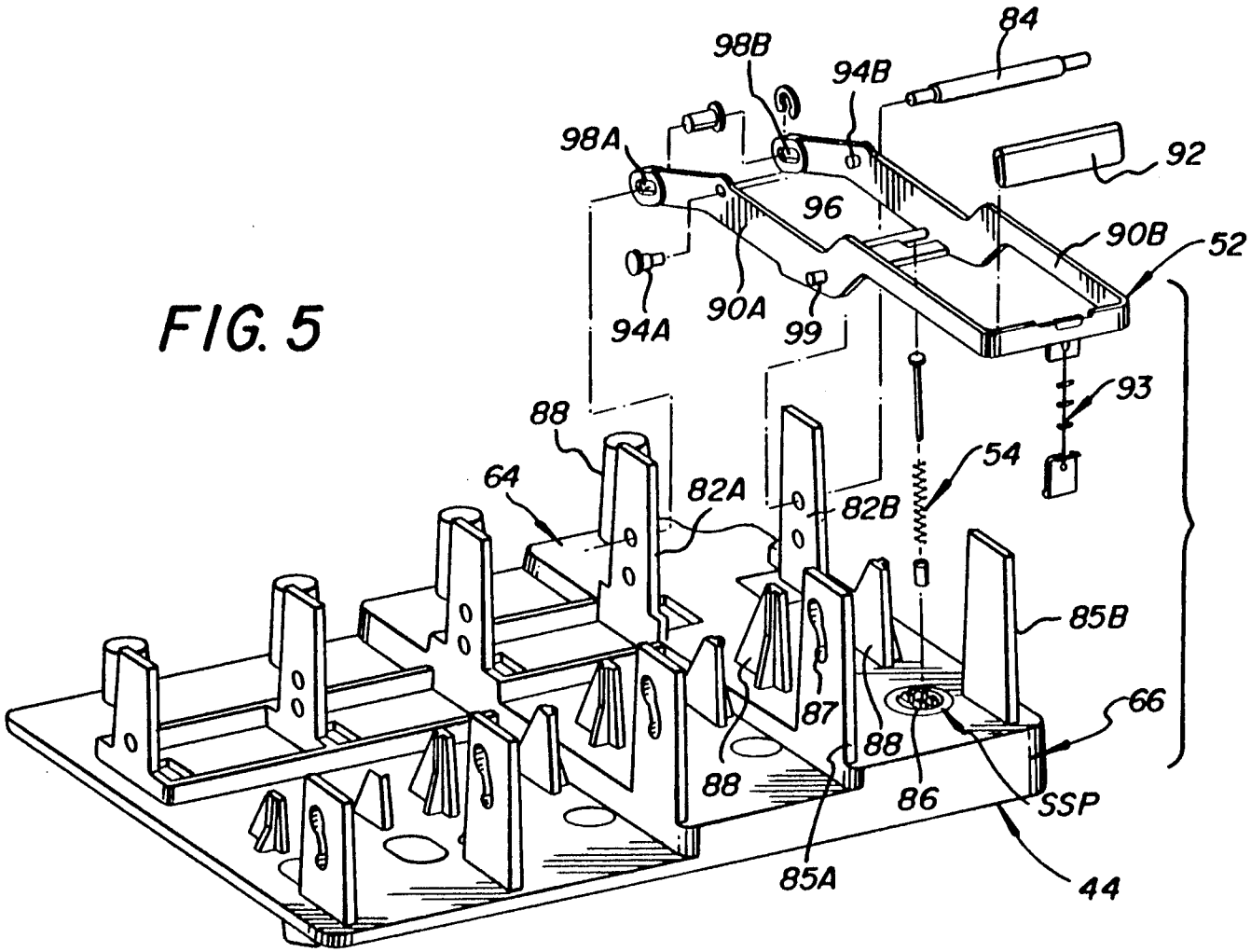
FIG. 5 is an exploded view of the chassis and lever assemblies of the present invention.

Referring now to the exploded view of FIG. 5, the entire chassis for the copier or printer 1 is illustrated together with the lifting mechanism for the chassis assembly 44 of one of the development stations 10. The entire chassis of course provides room for chassis assemblies 44 for up to four development stations. The disclosure of the present invention will be described with reference only to one such development station, but it is understood such description equally applies to the other stations.

As shown, each chassis assembly 44 includes means such as a pair of rear-end upright members 82A, 82B, and a rod 84 mountable to such members, for supporting the lever assembly 52. Adjacent development stations conveniently can share upright members. The front and rear ends 66, 64, respectively, of the chassis assembly 44 correspond to those 66, 64 of the development station 10. The chassis assembly unit 44 also includes a pair of front-end upright members 85A, 85B, one of which includes a dual axis guiding slot 87 for guiding the lever assembly 52 between the upraised development position and the lowered service position. Towards the front end 66 of the chassis assembly each unit includes a recess means 86 in the base thereof for swivellably supporting the spring and plunger assembly 54 at the point SSP FIG. 4. Each chassis assembly unit also includes stop means shown as 88 which stop and then support the platform and development unit assembly in their lowered service position.

The lever assembly 52 includes first and second side arm members 90A, 90B, respectively, which may be connected to the front as shown. A suitable manual grip member 92 may be provided for the front portion of the arm members for use by a operator in moving the lever assembly from the upraised position to the lowered position, FIG. 10.

A latching member 93 is provided to the front of the arms 90A, 90B for safely latching the lever assembly and the weights of the platform and development unit in the lowered position.

The lever assembly 52 also includes a first coupling means shown as pins 94A, 94B for coupling the arm members 90A, 90B, respectively, to the platform assembly 42. The pins 94A, 94B are located at the point LPP, FIG. 4 and cooperate with the holes 78A, 78B on the platform assembly 42. The lever assembly 52 further includes a second coupling means shown as a cylindrical cross-member 96 for coupling the lever assembly 52 to the spring and plunger assembly 54.

Inclined displacement slots 98A, 98B, are provided at the rear end of the arm members 90A, 90B respectively, for assembly about the support rod 84. Finally, a lever assembly guide pin 99 is provided for example on the side arm 90A for cooperating with the dual axis guide slot 87 in the front end upright member 85A. The pin 99 and slot 87 operate to effectively shift the development unit, the platform assembly and the lever assembly frontwards, that is, horizontally, when the same are moved, that is simultaneously, from the upraised position to the lowered position. The reverse is of course true when the same are lifted from the lowered position to the upraised position.

Figure 6:
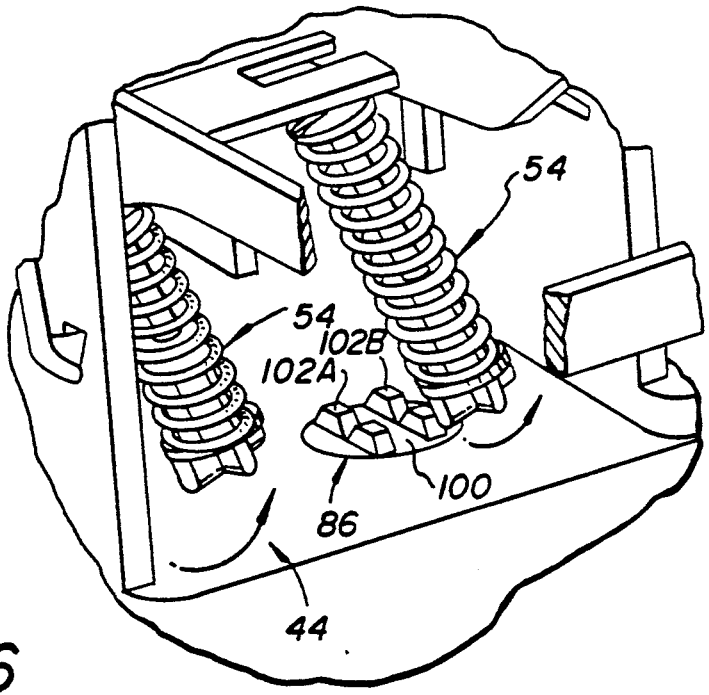
FIG. 6 is an enlarged perspective view of the means for swivellably supporting the spring and plunger assembly of the present invention.

Referring now to FIG. 6, an enlarged perspective view of the recess means 86 in the base of the chassis 44 is shown. The lower portion of the spring and plunger assembly 54 is shown shifted inoperatively to the right (per the FIG.) in order to reveal the details of the means 86. As revealed, the recess means 86 includes a retaining slot 100, and first and second V-shaped recesses 102A, 102B on first and second opposite edges of the slot 100.

Figure 7:
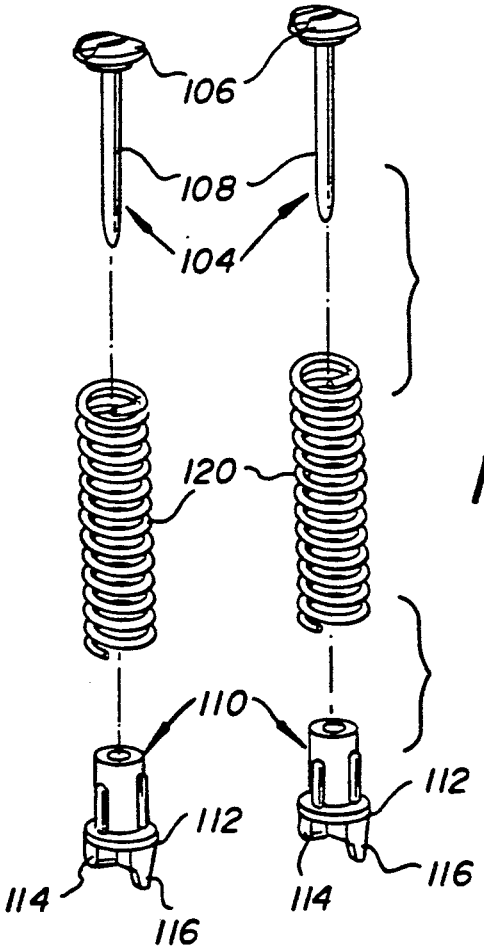
FIG. 7 is an exploded view of the spring and plunger assembly of the present invention.

The spring and plunger assembly 54 as shown in FIG. 7 includes a plunger 104 that has means such as a radiused groove or slot 106 at the top thereof for coupling the assembly 54 to the cylindrical member 96 of the lever assembly. The plunger 104 also includes a stem portion 108. The assembly 54 also includes a plunger cup 110 for releasably receiving and containing the stem 108 of the plunger 104. The base 112 of the plunger cup 110 is substantially circular and includes a diametrically extending and raised cylindrical member 114, as well as an axially projecting finger-like member 116. When positioned and held in the recess member 86, the cylindrical member 114 rests swivellably within the V-shaped recesses 102A, 102B, and the finger-like member projects into, and is retained in the slot 100.

As further shown, the spring and plunger assembly 54 includes a spring 120 which is designed to be easily compressed by an operator, especially along with the weight of the platform and development unit assemblies thereon, from the upraised position down to the lowered position. The spring 120 is also designed so as to be capable of automatically displacing and holding the total weight of such platform and development unit between the lowered and raised positions.

It is one advantage of the present invention that the weight capability of the mounting system 40 can be easily changed to accommodate heavier or lighter weight totals of the development unit and platform merely by changing the spring 120 of each spring and plunger assembly 54. In addition, the assembly and mounting of the spring and plunger assembly 54 as described above requires no tools since it can be easily accomplished manually.

Figure 8:
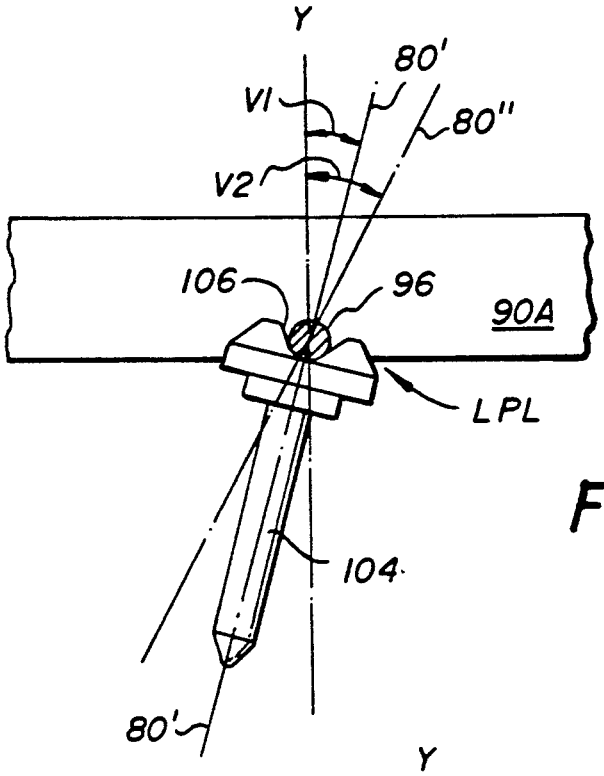
FIG. 8 is an enlarged illustration of the lever and plunger coupling of the present invention.
Figure 9:
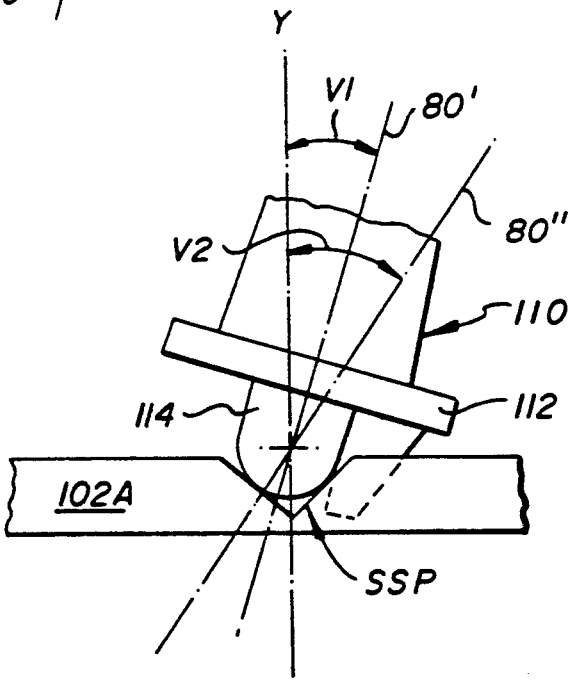
FIG. 9 is an enlarged illustration of the plunger cup and swivellable supporting means of the chassis assembly.

The swivelling behavior of the spring and plunger assembly 54 is illustrated in FIGS. 8 and 9. As shown, when the lever assembly 52 is in the upraised position, the spring and plunger assembly 54 will be located such that its axis (which lies along a line shown as 80') is inclined at a first angle V1 from the vertical or Y-axis, and backwards (front-to-back 66 to 64) along the Z-or horizontal axis. When the lever assembly 52 is moved from the upraised position to the lowered position, the spring and plunger assembly 54 swivels both at the points LPL and SSP and moves such that its axis (which lies along a line shown as 80'') is inclined a second and greater angle V2 from the vertical axis, and also backwards relative to the Z-axis.

Figure 10:
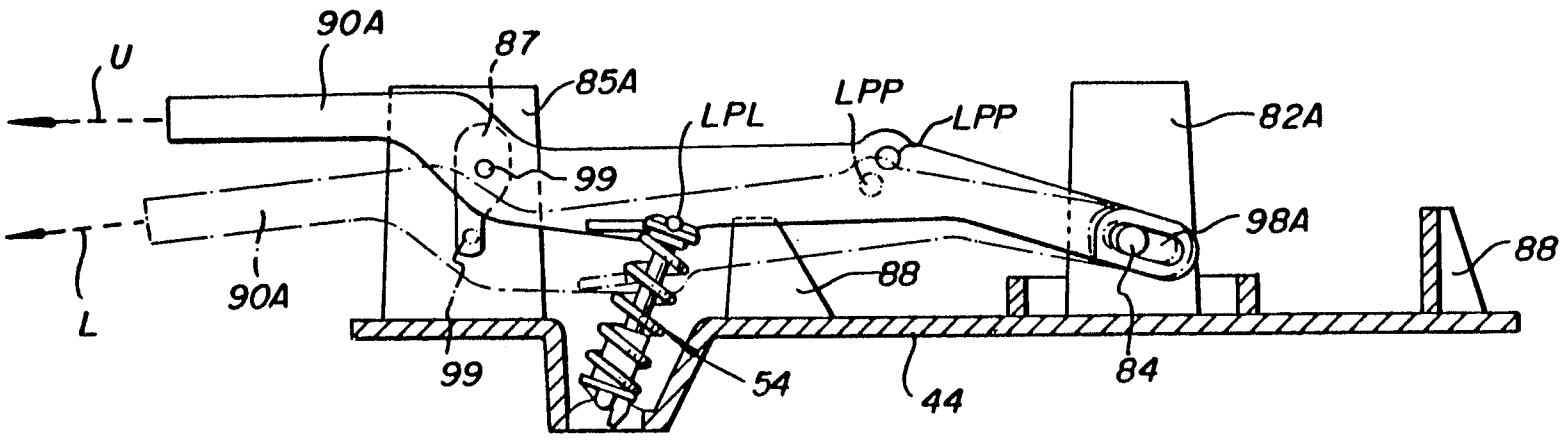
FIG. 10 is a side view, partly in section, of the lever assembly of the present invention showing the lowered service position and the upraised development positions of such lever assembly.

Referring now to FIG. 10, the behavior of the lever guide pin 99, the cooperating slot 87 and those of the inclined slot 98A and cooperating rod 84 are illustrated for when the lever assembly is lifted from the lowered position (shown as L) to the upraised position (shown as U). Essentially, with the spring 120 pushing in a generally diagonal direction on the released lever assembly 52, the guide pin 99 initially moves in a vertical direction, restricted by the bottom and narrow portion of the slot 87. During such initial movement, the arm members 90A, 90B merely pivot about the rod 84. Shortly thereafter, the pin 99 is released within the larger upper portion of the slot 87. Just then, the arm members 90A, 90B as pushed in a generally diagonally direction by the spring and plunger assembly 54 at LPL, slide rearwards relative to the rod 84 made possible by the inclined slots 98A, 98B. At the same time, there is continued pivoting of the arms 90A, 90B relative to the rod 84 because of the inclined nature of the slots 98A, 98B. Furthermore, because the lifting force application points LPL and LPP are offset to the same side (frontwards) of the center of gravity CG of the load being lifted FIG. 4, there is a resulting pivoting of the development unit and platform assembly about the point LPP towards the rear 64 of the station 10, and swivelling at the points LPP and SSP.

Figure 11A:
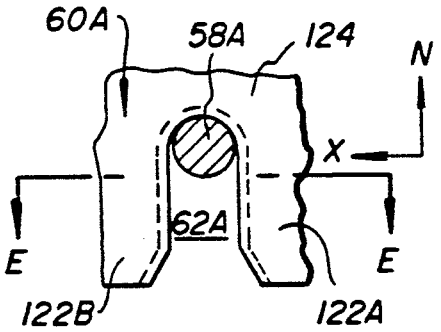
FIG. 11A is a top rear-to-front view of the film core guide pin and development unit fork-slot members of the present invention in the upraised development position.
Figure 11C:
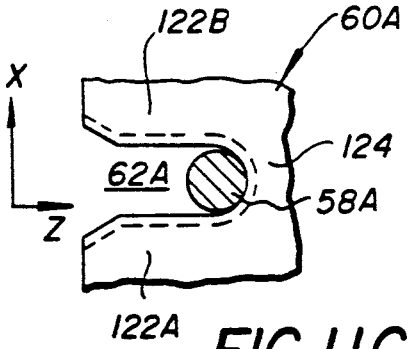
FIG. 11C is a right-to-left top view of the members of FIG. 11A.
Figure 11B:
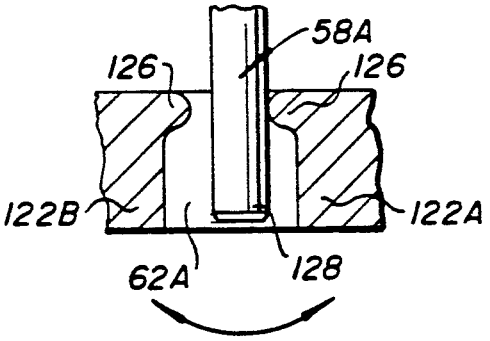
FIG. 11B is a vertical rear-to-front view, partly in section, of FIG. 11A.

Such rearward pivoting of the development unit 13 after the initial vertical travel of the lever arms 90A, 90B, quickly results in a substantially Z-axis restraining of the development unit 13 relative to the frame or film core F/C. As illustrated in FIGS. 11A–12D, such Z-axis restraining as well as the lowered-to-upraised positions travel of the development unit 13 are partially effected by the means 56 of the station 10. Referring now to FIG. 11A, the rear means 56 is shown including the guide pin 58A, the fork member 60A and the slot 62A. The view is a rear-to-front top view thereof. The fork member 60A includes first and second fingers 122A, 122B, and a seat portion 124 adjoining the base of the slot 62A. When the development unit 13 is in the upraised position as shown in FIGS. 11A to 11D, the guide pin 58A will come to rest substantially on the base of the slot 62A at such seat portion 124. FIG. 11B is a vertical section taken, for example, along the plane E—E and reveals a projecting pivot rim portion 126 formed at the interior edge of the slot 62A.

Figure 11D:
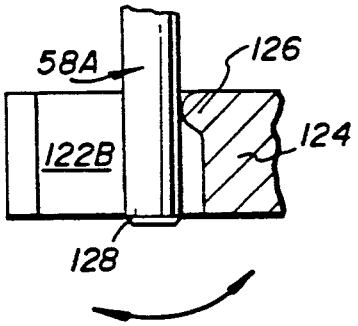
FIG. 11D is a vertical side view, partly in section, of the members of FIG. 11C in the upraised position.

The design is such that the projecting rim portion 126 is to the side of the slot 62A that is further away from the distal end 128 of the guide pin 58A when the development unit 13 is in the upraised position. As such, the projecting rim portion 126 as shown is to the top side of the slot 62A, but to the bottom or lower side of the front slot 62B on the film core F/C. As shown in FIGS. 11C and 11D, the rim portion 126 is provided all the way around the slot 62A including the seat portion 124. Accordingly, the development unit when in the upraised position, is free to pivot on the guide pin 58A against the rim 126 in both the X- (side-to-side) and Z- (rear-to-front) axes, as shown.

Figure 12A:
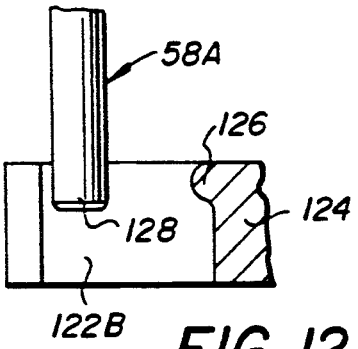
FIG. 12A is the view of the members of FIG. 11D in the lowered service position.
Figure 12B:
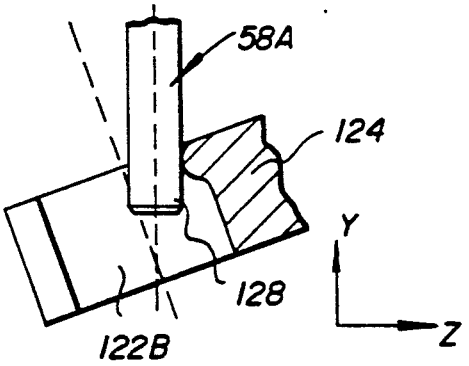
FIG. 12B is the view of the members of FIG. 11D at the commencement of displacement from the lowered to the upraised position.
Figure 12C:
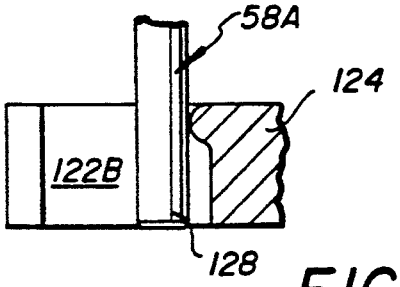
FIG. 12C is the same view as that of FIG. 11D.
Figure 12D:
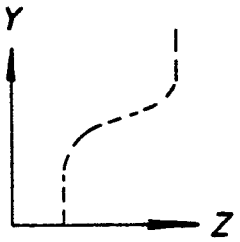
FIG. 12D is a graphical illustration of the axial travel path of the present invention.

As shown in FIGS. 12A–12D, when the mounting system 40, and hence the development unit 13, are in the lowered position L, the guide pin 58A will be remote from the seat portion 124 of the fork member 60A. The distal end 128 of the pin 58A will also be remote from the lower or bottom side of the slot 62A and hence close to the rim portion 126. During the initial vertical travel of the mounting system 40, the fork member 60A will also initially travel vertically relative to the stationary guide pin 58A in the rear. Again the reverse is true of the guide pin and fork-slot arrangement 58B, 62B/60B to the front of the station 10. As shown in FIG. 12B, as soon as the lever pin 99 is freed in the upper portion of the dual axis slot 87 as described above and the development unit 13 is pivoted at LPP, the seat portion 124 of the fork member 60A will also be tilted as shown. Such tilting will bring the projecting rim 126 thereat into a substantially Z-axis restraining contact with the stationary pin 58A even as the rim 126 also continues to move upwards in the Y- axis on the pin 58A. Eventually, the entire development unit 13 will level out and assume the upraised position of FIG. 11D as also shown in FIG. 12C. The dual axis and independent movement of the development unit as such is accomplished easily and gently such that there is virtually no risk of dusting or overloading against the film core F/C. The axial travel path of the present invention is illustrated in FIG. 12D.

As can be seen, a development unit mounting system 40 has been provided that independently interfaces the development unit and the image bearing member or film 2 without dusting or overloading. The dual axis lifting mechanism of the system 40 is simple and easy to operate, in addition to be desirably versatile with respect to the weight of the development unit and platform assemblies.

The invention has been described in detail with particular reference to a presently preferred embodiment, but it will be understood that variations and modifications can be effected within the spirit and scope of the invention.

What is claimed is:

1. In an electrostatographic reproduction apparatus including an image-bearing member for forming latent images thereon and a development unit for developing such images, a development unit mounting system, the mounting system including:

(a) a platform for holding the development unit;

(b) a chassis assembly having means for supporting said platform and said development unit; and (c) an automatic lifting mechanism for lifting said platform and said development unit from a lowered service position to an upraised development position, said lifting mechanism including a lever assembly displaceable simultaneously, along the vertical and horizontal axes, and a swivellable spring and plunger assembly for automatically imparting a generally diagonal displacement force to said lever assembly.

2. An electrostatographic reproduction apparatus including an image-bearing member for forming latent images thereon and a development station for developing such latent images using developer material, the development station including:

(a) an elongate development unit having a front end and a rear end for moving developer material relative to latent images on the image-bearing member;

(b) a system for mounting said development unit relative to the image-bearing member, said mounting system including (i) means including a chassis assembly and a development unit holding platform for supporting said development unit in an upraised development position adjacent the image-bearing member and in a lowered service position away from the image-bearing member, and (ii) an automatic mechanism for lifting said development unit holding platform from said lowered service position into said upraised development position, said lifting mechanism including a lever assembly displaceable along the vertical axis and along the horizontal axis, and a plunger assembly for imparting a generally diagonal displacement force to said lever assembly; and (c) means, associated with said development unit and with means supporting the image-bearing member, for guiding and precisely locating said development unit relative to the image-bearing member between said upraised development position and said lowered service position.

3. The electrostatographic reproduction apparatus of claim 2 wherein said chassis assembly includes means for displaceably supporting and guiding said lever assembly, recess means for swivellably supporting said spring and plunger assembly, and means for stopping and supporting said development unit holding platform in said lowered service position.

4. The electrostatographic reproduction apparatus of claim 2 wherein said development unit holding platform includes means for coupling said platform to said lever assembly, and wherein said coupling means are located offset frontwards from the center of gravity of said development and said platform.

5. The electrostatographic reproduction apparatus of claim 2 wherein said lever assembly includes first and second side arm members, first coupling means for coupling said arm members to said platform, second coupling means for coupling said arm members to said spring and plunger assembly, and an inclined displacement slot at the rear end of each said arm member.

6. The electrostatographic reproduction apparatus of claim 2 wherein said spring and plunger assembly includes (a) a plunger having means for coupling said plunger to said lever assembly, (b) a plunger cup for releasably receiving said plunger, said plunger cup having means for swivellably positioning said spring and plunger assembly in said recess means in said chassis assembly, and (c) a spring for supporting and forcing displacement of said development unit holding platform from said lowered position to said upraised position.

7. The electrostatographic reproduction apparatus of claim 3 wherein said recess means for swivellably supporting said spring and plunger assembly includes a slot and a pair of V-shaped recesses on first and second edges of said slot.

8. The electrostatographic reproduction apparatus of claim 2 wherein said lever assembly is displaceable simultaneously along the vertical and horizontal axis.

9. The electrostatographic reproduction apparatus of claim 2 wherein said plunger assembly includes a force applying spring.

10. The electrostatographic reproduction apparatus of claim 2 wherein said plunger assembly is coupled swivellably to said chassis assembly.

* * * * *